US007267242B2

(12) United States Patent
Tanaka et al.

(10) Patent No.: US 7,267,242 B2
(45) Date of Patent: Sep. 11, 2007

(54) BOTTLE-SHAPED CONTAINER INCLUDING AN ANNULAR PROJECTION

(75) Inventors: Toshimasa Tanaka, Koto-ku (JP); Naoki Tsutsui, Koto-ku (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 418 days.

(21) Appl. No.: 10/490,253

(22) PCT Filed: Sep. 24, 2002

(86) PCT No.: PCT/JP02/09776

§ 371 (c)(1),
(2), (4) Date: Oct. 22, 2004

(87) PCT Pub. No.: WO03/026975

PCT Pub. Date: Apr. 3, 2003

(65) Prior Publication Data

US 2005/0067370 A1 Mar. 31, 2005

(30) Foreign Application Priority Data

Sep. 26, 2001 (JP) ..... 2001-294098

(51) Int. Cl.
*B65D 1/02* (2006.01)
*B65D 1/46* (2006.01)

(52) U.S. Cl. ..... 215/383; 215/382; 220/669; 220/672; 220/675

(58) Field of Classification Search ..... 215/379, 215/381–383, 284, 900; 220/668, 682, 669, 220/672, 666, 675
See application file for complete search history.

(56) References Cited

U.S. PATENT DOCUMENTS

| | | | | | |
|---|---|---|---|---|---|
| 255,900 | A | * | 4/1882 | Thorpe | 215/386 |
| 2,169,869 | A | * | 8/1939 | Blunt | 215/383 |
| 3,050,773 | A | * | 8/1962 | Hagen | 264/534 |
| 3,298,514 | A | * | 1/1967 | Erickson | 206/145 |
| 4,055,273 | A | * | 10/1977 | Jones | 220/631 |
| 4,610,366 | A | * | 9/1986 | Estes et al. | 426/106 |
| D294,118 | S | * | 2/1988 | Papa | D9/390 |

(Continued)

FOREIGN PATENT DOCUMENTS

| | | |
|---|---|---|
| CH | 396 668 | 7/1965 |

(Continued)

*Primary Examiner*—Sue A. Weaver
(74) *Attorney, Agent, or Firm*—Oliff & Berridge, PLC

(57) ABSTRACT

A bottle-shaped container according to the present invention includes a mouth portion (1) for discharging contents, a shoulder portion (2), a main body portion (3), and a bottom portion (4), wherein these portions are integrally molded and successively arranged with each other. An annular projection (5) surrounds the main body portion (3) and protrudes from a surface thereof, along a boundary between the shoulder portion (2) and the main body portion (3). Further, narrow grooves (6*a*, 6*b*) are provided on both sides of the annular projection (5) to extend along the same, respectively.

1 Claim, 2 Drawing Sheets

U.S. PATENT DOCUMENTS

| | | | | | |
|---|---|---|---|---|---|
| 5,178,290 | A | | 1/1993 | Ota et al. | |
| 5,217,128 | A | | 6/1993 | Stenger | |
| 5,303,833 | A | * | 4/1994 | Hayashi et al. | 215/381 |
| D393,802 | S | * | 4/1998 | Collette et al. | D9/502 |
| 5,988,417 | A | * | 11/1999 | Cheng et al. | 215/383 |
| D421,572 | S | * | 3/2000 | Herrmann | D9/503 |
| 6,044,996 | A | * | 4/2000 | Carew et al. | 215/381 |
| D454,792 | S | * | 3/2002 | Keller | D9/557 |
| 2001/0006165 | A1 | | 7/2001 | Rashid | |

FOREIGN PATENT DOCUMENTS

| | | | | |
|---|---|---|---|---|
| DE | 3123902 | A1 | * | 6/1982 |
| FR | 1408869 | | | 8/1965 |
| GB | 2101071 | A | * | 1/1983 |
| JP | A-11-301633 | | | 11/1991 |
| JP | A 08-230855 | | | 9/1996 |
| JP | 2001097448 | A | * | 4/2001 |
| KR | U 96-27047 | | | 8/1996 |

* cited by examiner

BOTTLE-SHAPED CONTAINER INCLUDING AN ANNULAR PROJECTION

BACKGROUND ART

1. Technical Field

The present invention relates to a bottle-shaped container made of thermoplastic resin, and intends to advantageously avoid lowering of the mechanical strength due to a light-weighted or thin-walled nature of the container.

2. Related Art

Synthetic resin containers, such as PET bottles, have been widely used as containers, e.g., for filling therein foods, beverages, cosmetics or medicines since such containers are light in weight and can thus be easily handled, have transparency to exhibit a refined appearance comparable to glass containers, and can be produced at low cost.

Synthetic resin containers have a relatively low mechanical strength against external forces. Therefore, when the container is gripped at its main body portion for pouring the contents out of the container, the container inevitably undergoes deformation at its gripped part.

It is thus a typical countermeasure to appropriately control the container wall thickness and form longitudinal ribs, lateral ribs or waists (i.e., circumferential grooves surrounding the main body portion) so as to improve the resistances of the container to external forces, such as rigidity, buckling strength, etc.

However, there is an increasing demand for thin-walled (or light-weighted) containers so as to reduce the resin amount to be used per one container from a standpoint of effective utilization of resources and reduction in the amount of wastes, resulting in a situation where the strength of the container is inevitably further lowered to deal with such a demand.

Particularly, in connection with PET bottles having a filling volume of about 500 milliliters, various kinds of commercial products have been recently increasingly sold by vending machines. In this instance, when such a bottle is light-weighted, there tends to be caused troubles wherein recesses are formed on the bottle at its lateral side (particularly, at its shoulder portion) due to an impact caused by dropping of the bottles from the storage down to the outlets, via chutes of the vending machines.

DISCLOSURE OF THE INVENTION

It is therefore an object of the present invention to provide an improved bottle-shaped container capable of retaining its initial shape even when the container is light-weighted and thin-walled.

According to the present invention, there is provided a bottle-shaped container comprising a mouth portion for discharging contents, a shoulder portion, a main body portion, and a bottom portion, wherein these portions are integrally molded and successively arranged with each other, said bottle-shaped container further comprising: an annular projection surrounding the main body portion and protruding from a surface thereof, along a boundary between the shoulder portion and the main body portion; and narrow grooves provided on both sides of the annular projection to extend along the same, respectively.

In the bottle-shaped container according to the present invention, the annular projection preferably defines the maximum dimension of the container, i.e., the maximum diameter in the case of a container having a circular cross-section.

BRIEF DESCRIPTION OF THE DRAWINGS

The present invention will be described in further detail hereinafter, with reference to a preferred embodiment shown in the drawings.

BEST MODE FOR CARRYING OUT THE INVENTION

Figure 1:
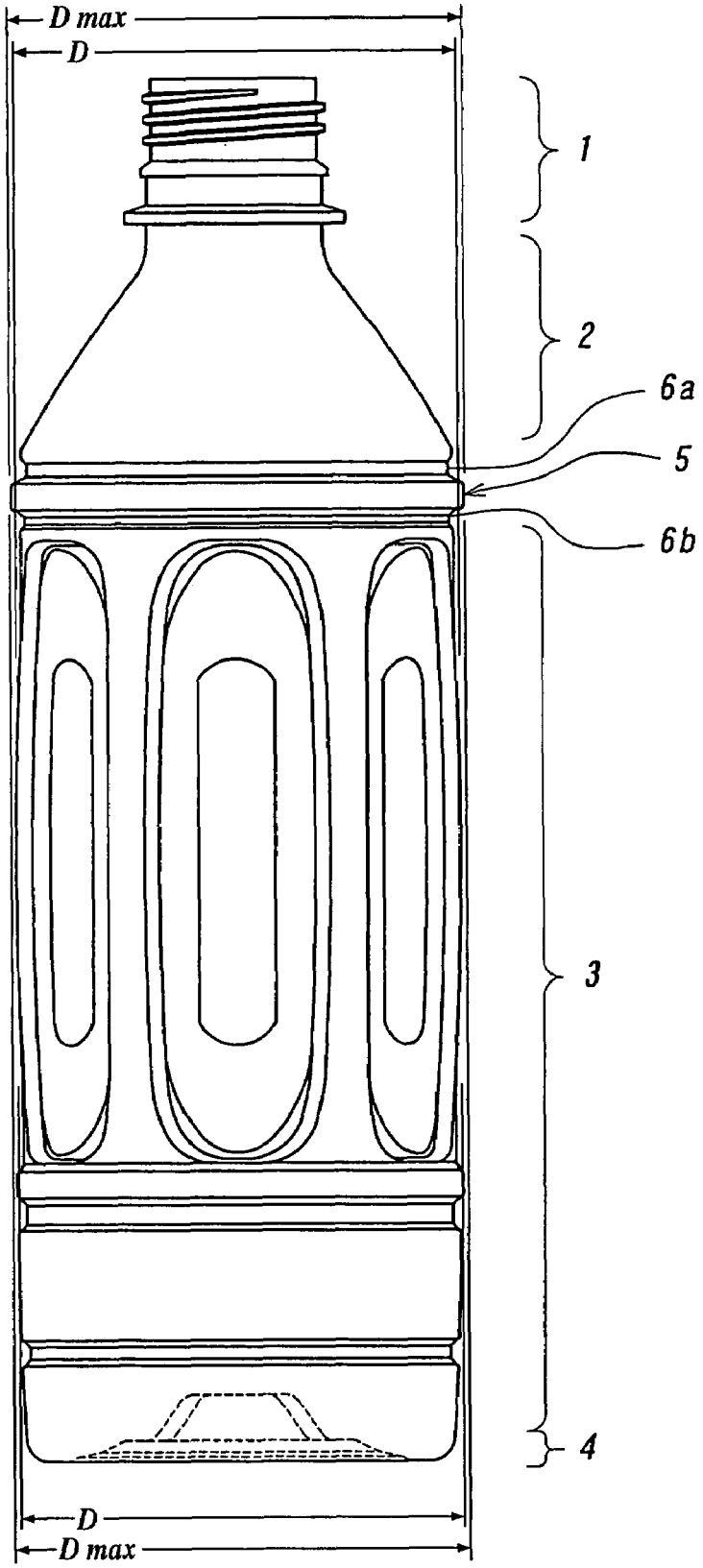
FIG. 1 is an explanatory view showing the structure of a bottle-shaped container according to one embodiment of the present invention.

FIG. 1 shows a bottle-shaped container according to the present invention, in a situation where the same is applied to a container having a filling volume of 500 milliliters.

In the drawings, reference numeral 1 denotes a mouth portion for discharging contents, 2 a shoulder portion arranged successively with the mouth portion 1, 3 a main body portion, and 4 a bottom portion. These portions are molded integrally with one another, by a biaxial-stretching blow molding of a preform made of a thermoplastic synthetic resin, such as polyethylene terephthalate.

Reference numeral 5 denotes an annular projection, which is formed at a boundary between the shoulder portion 2 and the main body portion 3, in the illustrated embodiment. This annular projection 5 is also integrally molded by the blow molding, so as to surround the main body portion 3 to extend over a full circle around the same.

Reference numerals 6*a*, 6*b* denote annular narrow grooves along both sides of the annular projection 5, i.e., along the upper and lower sides in the figure. In this embodiment, the narrow groove 6*a* has a groove width and a groove depth both larger than those of the narrow groove 6*b*, respectively.

Used for this size of container is about 30 grams of the resin amount per one container, and such a resin amount on one hand provides a certain degree of mechanical strength though, on the other hand, gives rise to a problem as follows. Namely, when the used amount of resin is reduced by about 20% so as to reduce the weight of the container, the obtained container is inevitably thin-walled and the mechanical strength is lowered particularly at the region from the shoulder portion 2 to the main body portion 3. Thus, a deformation in the above-mentioned region would be inevitable in a use condition wherein the container is dropped in a sideways falling posture within a vending machine.

Nonetheless, according to the present invention, the annular projection 5 functions to complement the strength over the lateral side of the container, so that the initial shape of the container is stably retained without causing any deformation even when the container is subjected to an impact, upon dropping or when the container is strongly gripped.

Figure 2:
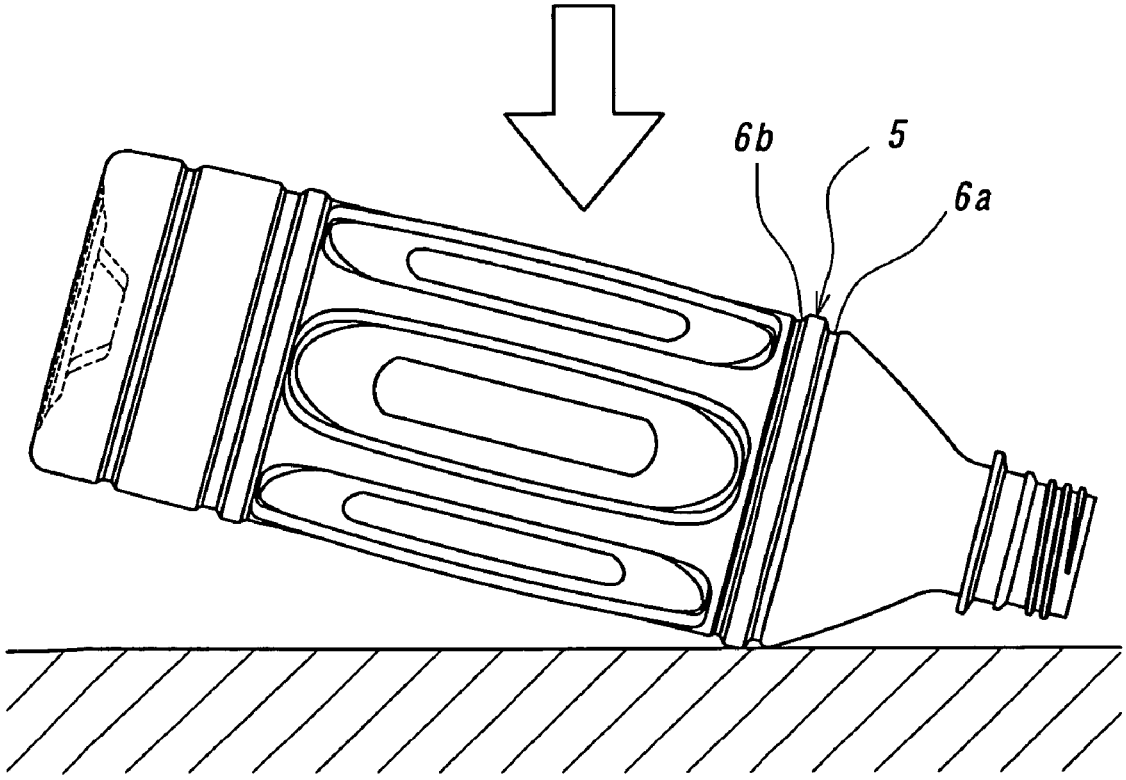
FIG. 2 is a view showing a dropped state of the container shown in FIG. 1.

The narrow grooves 6*a*, 6*b* arranged on both sides of, and adjacently to the annular projection 5 function as dampers for absorbing the impact applied through the annular projection 5. Thus, the impact applied through the annular projection 5 is not directly transmitted to the shoulder portion 2, nor to the main body portion 3. FIG. 2 schematically shows a state wherein the container of FIG. 1 is dropped onto a floor surface.

In order to effectively exhibit the functions of the annular projection 5 and the narrow grooves 6*a*, 6*b*, it is important that the annular projection 5 defines the maximum dimension (Dmax) of the container, where Dmax is larger than any other diameter D of the container at any other cross-section (Dmax>D, see FIG. 1).

Although FIG. 1 shows a container having a circular cross-section with a filling volume of 500 milliliters, the present invention is also applicable to containers having polygonal cross-sections, such as quadrilateral or pentagonal cross-sections, as well as to various small-sized bottles having a filling volume of less than 500 milliliter or to large-sized bottles having filling volumes exceeding 500 milliliters, without being limited to the container shown in FIG. 1.

Furthermore, although the narrow groove 6*a* has the groove width and the groove depth both larger than those of the narrow groove 6*b*, respectively, in the illustrated embodiment, the present invention is not limited to this embodiment and it is possible to appropriately set the groove widths and/or groove depths of the narrow grooves 6*a*, 6*b* and the width and/or projection amount (or diameter) of the annular projection 5, depending upon the size of the container. It is further preferred to provide rounded areas at corner portions of the narrow grooves 6*a*, 6*b* and annular the projection 5, respectively, so as to avoid stress concentrations. Additionally, the annular projection 5 is not limited to one in number as in the illustrated embodiment, and it is also possible to provide a plurality of annular projections.

While the present invention has been explained above with reference to a specific embodiment wherein the annular projection 5 and the narrow grooves 6*a*, 6*b* adjacent thereto are provided at the boundary between the shoulder portion 2 and main body portion 3, it is possible to appropriately provide the annular projection 5 and the narrow grooves 6*a*, 6*b* at suitable locations where an enhanced strength is required.

It will be appreciated from the foregoing description that, according to the present invention, the mechanical strength of the container can be ensured by the annular projection even when the used resin amount is reduced and the container is thin-walled to reduce the weight of the container, thereby enabling the initial shape inherently possessed by the container to be stably retained.

It is needless to say that the present invention is not limited to the above-mentioned embodiments, and may be carried out with numerous variants.

The invention claimed is:

1. A bottle-shaped container, comprising:

a mouth portion for discharging contents, a shoulder portion, a main body portion, and a bottom portion, wherein said portions are integrally molded and successively arranged with each other, said bottle-shaped container further comprising:

an annular projection surrounding said main body portion and protruding from a surface thereof, along a boundary between said shoulder portion and said main body portion; and narrow grooves provided on both sides of said annular projection to extend along the same, respectively, said annular projection defining a maximum cross-section dimension of said container.

* * * * *